5/20/86 XP 4,590,466

United States Patent [19]

Wiklund et al.

[11] Patent Number: 4,590,466

[45] Date of Patent: May 20, 1986

[54] METHOD AND APPARATUS FOR SAMPLING MEASUREMENT DATA FROM A CHEMICAL PROCESS

[75] Inventors: Klas R. Wiklund; Erik I. Johansson, both of Täby, Sweden

[73] Assignee: Pharos AB, Lidingö , Sweden

[21] Appl. No.: 505,996

[22] Filed: Jun. 20, 1983

[30] Foreign Application Priority Data

Jun. 28, 1982 [SE] Sweden ..... 8203983

[51] Int. Cl.[4] ..... G08C 17/00

[52] U.S. Cl. ..... 340/870.28; 340/825.06; 340/870.11; 340/870.16; 364/477; 374/137; 455/66

[58] Field of Search ..... 266/197; 73/432 A; 340/825.06, 870.28, 870.11, 870.16; 364/139, 477, 503; 374/137, 155, 183; 219/490, 494, 501, 509; 455/67

[56] References Cited

U.S. PATENT DOCUMENTS

| | | | |
|---|---|---|---|
| 3,310,736 | 3/1967 | Bayly | 340/870.28 |
| 3,333,476 | 8/1967 | Hardy | 340/870.28 |
| 3,905,010 | 9/1975 | Fitzpatrick | 340/870.28 |
| 3,940,752 | 2/1976 | Bair | 340/870.28 |
| 4,025,912 | 5/1977 | Rice | 340/870.28 |
| 4,090,170 | 5/1978 | Lincklaen-Arriens | 340/870.28 |
| 4,180,199 | 12/1979 | O'Rourke | 340/870.28 |
| 4,276,600 | 6/1981 | Beck | 364/477 |
| 4,461,459 | 7/1984 | Conti | 340/870.28 |
| 4,463,437 | 7/1984 | Schenck | 364/477 |

FOREIGN PATENT DOCUMENTS

| | | |
|---|---|---|
| 42303 | 2/1978 | Japan . |
| 14782 | 2/1980 | Japan . |
| 117942 | 8/1980 | Japan . |

*Primary Examiner*—John W. Caldwell, Sr.
*Assistant Examiner*—Michael F. Heim
*Attorney, Agent, or Firm*—Larson and Taylor

[57] ABSTRACT

A method and an apparatus of obtaining measurement data from a chemical process in a mass in a space, such as the charge in a blast furnace, is disclosed where the mass passes through the space from an inlet to an outlet and chemical and/or mechanical change in the mass takes place as it passes through the process. Sensors implemented as individual, unconnected units are mixed into the mass at the inlet, each sensor being equipped with a transmitter of acoustic or electromagnetic type, and with one or more sensing means connected to the transmitter for sensing the properties to be measured. The transmitter sends signals with information on the properties detected by the sensing means. Reception means for taking up acoustic or electromagnetic signals are placed outside the space with spreadout placing over the defining surface of the space. The position of the sensors inside the space is calculated with guidance from a property such as signal strength, time position, field direction or the like, of the signals sent by the different sensors and received wirelessly by said reception means. The properties of the surroundings measured by the sensing means of the sensors are finally presented for each sensor as measurement data for the calculated position of the sensor.

17 Claims, 8 Drawing Figures

METHOD AND APPARATUS FOR SAMPLING MEASUREMENT DATA FROM A CHEMICAL PROCESS

Figure 1:
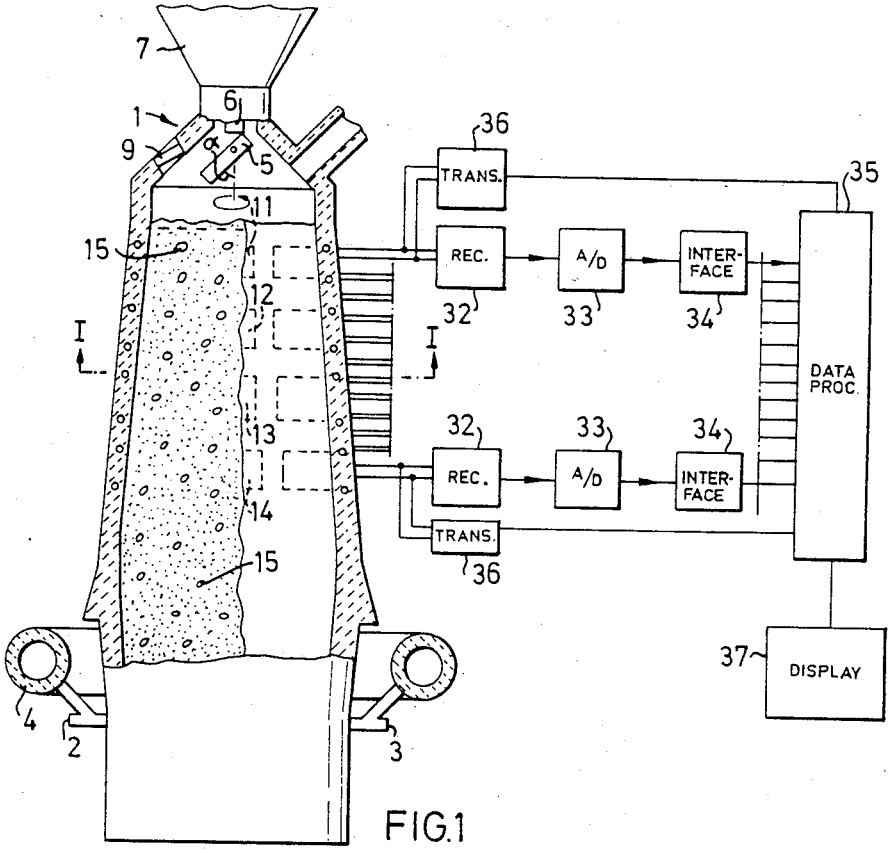

The invention relates to a method and apparatus for sampling measurement data from a chemical process, e.g. of the type proceeding in a blast furnace, where information is to be studied in different parts of the space studied, and the mass in the space goes through the process from an inlet with a given mechanical-chemical implementation in the process and where a chemical and/or mechanical change takes place.

Previously, it has been very difficult continuously to monitor such a process. It has been possible to take spot checks, but particularly in such processes which are as difficult, from the environmental aspect, as those taking place in blast furnaces, such spot checks have only been possible very infrequently. Such checks have therefore not been possible for a continuous process, and have been taken almost exclusively for research purposes to investigate what actually takes place inside a blast furnace during the process.

Sensors are sometimes used for monitoring the chemical process, and in such cases they are placed in the exhaust gas duct at the top of the furnace for sensing different chemical components. However, the chemical process inside the charge does not proceed homogeneously, not even seen as a cross section through the charge, and investigations have shown that the junctions between zones with different temperatures, and thus the junction between a zone with material in clumps and a zone with material becoming soft, as well as the junction between the zone of such material and a zone with fused material, substantially have the form of cones with their vertexes facing upwards.

It is essential to know how the different zones are distributed in the furnace, and it is particularly interesting to find out at an early stage if some uneven distribution begins to occur, where one or more zones are no longer centered about the central axis of the furnace. It is very important, both for the operational mode of the furnace, and for the quality of the tapped iron, that the furnace operates as symmetrically as possible about its central axis, so that the hottest part of the furnace is to be found as near the furnace's central axis as possible. In the case where heating is distributed unevenly, the furnace wall becomes heated, and in rare cases a part of the wall can be overheated to such an extent that it fails. Modern blast furnaces are made with considerably greater diameters than what was usually the case in older furnaces, so that their operation will be as economical as possible. A larger furnace is, however, considerably more susceptible to disturbances in the form of non-uniform distribution of the charge than a smaller furnace. This is because the larger the furnace is, the more difficult it is to achieve symmetrical heating about the central axis of the furnace. Therefore is has long been a desire to monitor the process continuously and at different levels in the process for both operational control, e.g. the early discovery of uneven distribution, and research purposes.

In accordance with the invention, sensors with transmitters of acoustic or electromagnetic type, and equipped with one or more sensing means, e.g. for sensing temperature, pressure, different chemical components such as CO etc.,; are mixed with the material which is fed into the process which is to be investigated.

In the wall of the reactor, e.g. the blast furnace, in which the process is in progress, there are aerials or antennae, walled-in or otherwise, mounted and distributed such that the position for a transmitting sensor can be calculated from the signal strength and/or the time position and/or the direction of the field vector for the E or H fields of a received signal. This is accomplished, with the aid of a receiver unit connected to the antenna, which measures signal strength and/or time position and/or the field direction for a first pulse and possibly decodes the signal information and identifies the individual sensors. In order that the sensors may be individually identifiable, they may be equipped to send only on call, or they can send regularly at given times, or they may send information on different carrier frequences, such as information concerning temperature and chemical composition of their environment.

When sensors are to be used in hot and chemically corrosive environments, such as those in blast furnaces, the sensors should have a casing giving strong protection against heat, chemical attack and mechanical damage. Different ceramic material is suitable for this. The casing can also be soaked or enclosed in a liquid which boils off under the action of heat, thus keeping the temperature in the interior of the sensor below a determined value.

Figure 2A:
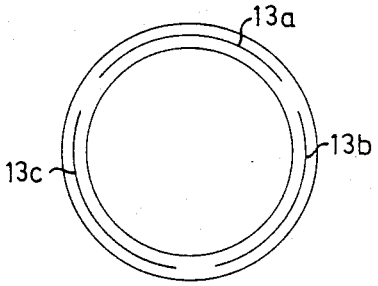
Figure 2B:
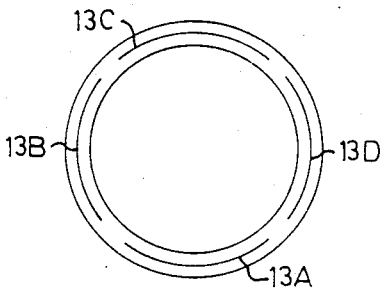
Figure 3:
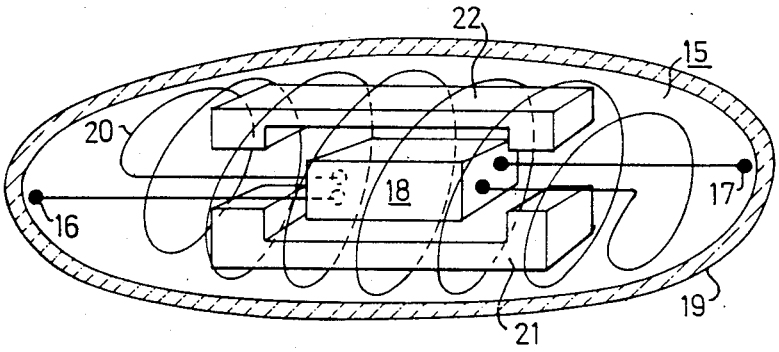
Figure 4:
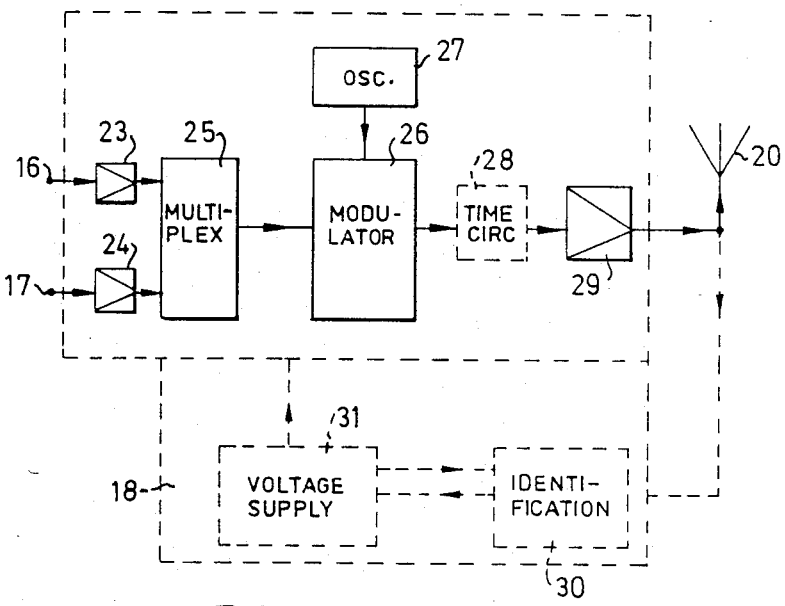
Figure 6:
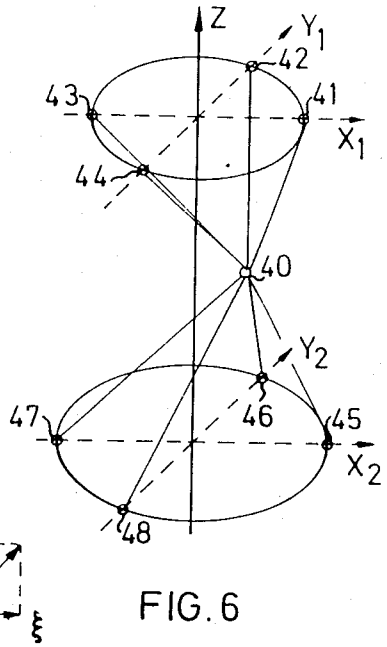
Figure 5:
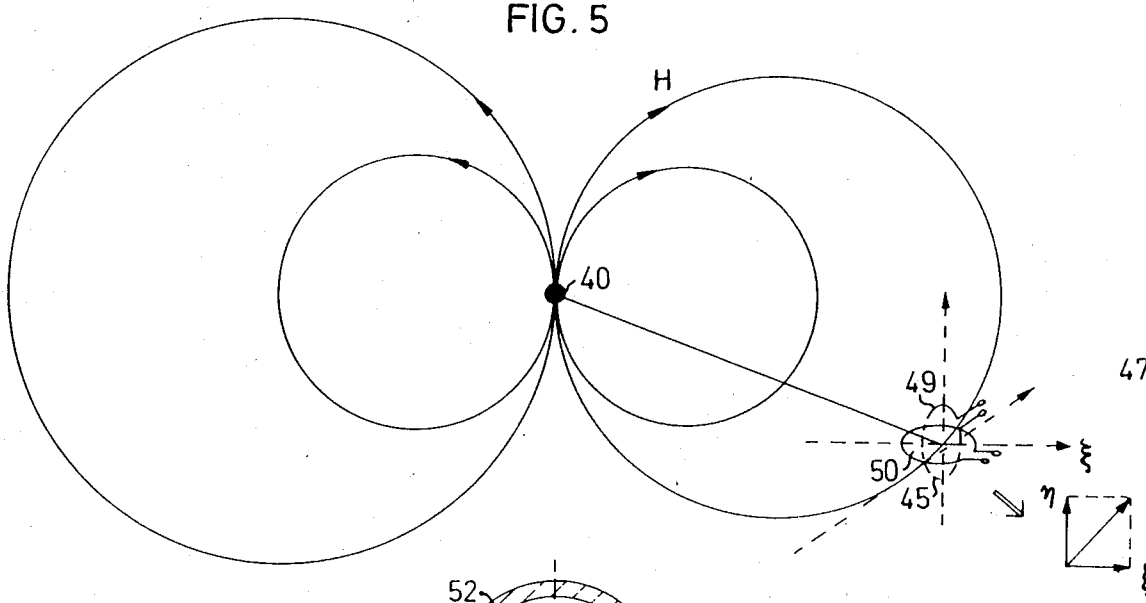
Figure 7:
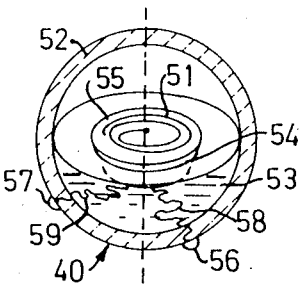

The invention will now be described in detail with reference to the accompanying drawings where FIG. 1 illustrates a blast furnace in cross section with its charge partly removed, and shows a first embodiment of an antenna arrangement for indicating the positions of individual sensors, FIGS. 2*a* and 2*b* illustrate different embodiments of a section along the line I—I in FIG. 1, FIG. 3 is a first embodiment of a sensor used in the method according to the invention, FIG. 4 is a block diagram of an embodiment of an electric circuit in a sensor, FIGS. 5 and 6 schematically illustrate a second embodiment of an antenna arrangement indicating the positions of individual sensors and FIG. 7 illustrates a second embodiment of a sensor.

A blast furnace 1 is illustrated in FIG. 1, having a number of tuyères 2,3 connected to a bustle pipe 4 encircling the furnace. Preheated blowing air is supplied to the bustle pipe for distribution and entry into the furnace via the tuyères.

The furnace is shown partially sectioned on the left hand side, and on the right hand side it is also partially sectioned but without the charge. A trough 5 is arranged at the top of the furnace, such that it is tippable into different positions in relation to a vertical axis and is rotatable about the central axis of the furnace. A pipe 6 concentric with the central axis opens out above the trough, charging material being emptied from the filling member 7 through the pipe and onto the trough 5, in predetermined proportions and to predetermined positions on the surface of the charge determined by the angle of trough 5, and the position to which it has been rotated.

For monitoring how the different zones in the blast furnace are distributed, and particularly to investigate whether there is some possible uneven distribution, antennae 11–14 are arranged in or at the furnace wall, in accordance with the invention. These antennae are illustrated as being let into the wall in FIGS. 1, 2*a* and 2*b*, preferably into the furnace lining, and thus are kept inside the steel jacket, to obtain good reception conditions for signals coming from the charge.

Sensors 15 are mixed into the material which is fed into the process from the filling member 7 via the pipe 6 and trough 5. One embodiment of a sensor suitable for use in the method in accordance with the invention is illustrated in FIG. 3.

The sensors 15 are equipped with one or more sensing means 16,17. These sensing means can be of different kinds and sense different properties in the environment of the sensor 15, such as temperature, CO content, contents of other chemical substances, atmospheric pressure etc. An electronic unit 18 is placed in the middle of the sensor, and signals from the sensing means 16,17 are fed to it.

Shields 21,22 can be arranged around the electronic unit 18 and implemented as porous ceramic soaked with liquid, which boils off under the effect of heat from the surroundings. The temperature of the electronic unit is thus kept below a given maximum. The sensor 15 is provided with a casing 19, which lets through the evaporating liquid, but is simultaneously heavily protective against heat and chemical attack from the surrounding atmosphere.

A transmitter antenna is located inside the casing 19. FIG. 3 illustrates this antenna as a frame antenna in a loop inside the casing. It is obvious that other suitable antennae are just as useful. The antenna may be made integral with the casing, such that on the heat insulating material on the inside of the casing there is a layer of electrically conductive material onto which the antenna is etched.

An embodiment of the electronic unit 18 is illustrated in a block diagram in FIG. 4. The signal from each of the sensing means 16,17 is amplified in an amplifier 23,24. The amplifier outputs are each connected to an input on a multiplexer unit 25, which has its output connected to the signal input of a modulator 26. An oscillator 27, used as a carrying frequency generator, is connected to another input on the modulator. The modulator modulates the signal from the multiplexer unit 25 on the carrying frequency signal fed from the oscillator with some suitable modulation, e.g. pulse code or pulse frequency modulation.

The oscillators 27 of the different sensors which are placed amongst the charge can have different individual frequencies. Instead of, or supplementary to, different individual frequencies of the oscillator 27, the sensors 15 may be provided with a time circuit 28 connected to the output of the modulator 26, said time circuit 28 being adapted to let through output signals from the modulator 26 at given, individual times for the different sensors, to an amplifier 29 and further to the antenna 20. The time circuit 28 may also be placed at some other place in the block diagram than the one shown, e.g. it may be adapted to control the voltage supply for the circuits 23–27,29, so that these are only supplied voltage during predetermined time intervals. The electronic unit thus operates with great current economy. Since the sensor 15 has an inner portion cooled by the shields 21,22, and the temperature around the sensor is considerably hotter, the sensor does not need to be provided with an ordinary battery, and current supply can be arranged with one or more thermoelements. These thermoelements are thus activated when the sensors have come into the hot charge in the blast furnace. The sensors can thus be stored for long periods before they are used, without being destroyed.

It is also possible to provide each sensor with an identfication unit 30 connected to the antenna 20. On call from any of the antennae 11–14 in the furnace wall with the individual sensor code, the identifying unit 30 activates the sensor voltage feed 31 such that the circuits 23–29 are given a voltage. Information from the sensor is then sent out via the antenna 20 and received by the receiver antennae 11–14. In the case where the sensors have been provided with individually answering identifying units, the individual oscillators 27 in the sensors do not need to have different frequencies. The time circuit 28 is not necessary in this case either.

The intention is that the sensors are to be manufactured in large series and tipped into the filling member together with the other charge material. If either oscillators 27 with different frequencies or time circuits 28 with different times or identifying units 30 with different call codes are selected, these can be selected with such large variation that the risk of two identical sensors being in the charge simultaneously will be small. It is furthermore even less likely that precisely these two sensors are close to each other, whereby the signals obtained from them will deviate from a normal signal from a random sensor, such that in evaluating the answers from the sensors in the charge it will be easy to exclude the answers from the two identical sensors from affecting the final result of the measurement in progress. However, not being able to use all the sensors in the charge for evaluation is a drawback. One may therefore have a combination of two or all three of the abovementioned facilities. It is quite possible to use individual oscillators, individual time circuits and individual identifying units with such a large number of individual characteristics as fifty for each facility, e.g. carrier frequency, time position, identifying code, the probability will be almost infinitesimal for two sensors with the same characteristics to be in the charge at the same time. In practice a smaller number of possibilities is selected for economic reasons.

The receiver antennae 11–14 illustrated in FIGS. 1 and 2, which are let into the furnace lining, are placed in several rows one above the other. As will be seen from FIG. 2*a*, illustrating an embodiment in a section along the line I—I, in FIG. 1, there are three antennae 13*a*, 13*b*, 13*c*, in each row, which is the minimum for indicating the position of a sensor in horizontal projection. However, in FIG. 2*b* another embodiment is illustrated, also along the line I–I in FIG. 1, and includes four symmetrically placed antennae 13A,13B,13C,13D. The calculation of the position of a sensor in a horizontal projection will be somewhat easier with this configuration, since the signals from mutually opposing pairs of antennae 13A, 13C and 13B,13D can be evaluated simultaneously to give a one-dimensional indication of the position of the sensor, after which a combination of the two one-dimensional positions obtained from the two coacting antennae pairs can give a two-dimensional position.

Properly speaking, only two rows of antennae 11–14 need to be arranged for indicating the three-dimensional position of an individual sensor, but since the transmitted signals from the sensors 15 are attenuated by the surrounding charge, the antennae in the furnace wall need to be arranged relatively closely to enable the reception of the weak signals from the sensors, and to ensure reliable positional indication, particularly as the indication takes place with the aid of the signal strength of the received signal. By using many antennae there is obtained a more reliable positional indication of each sensor.

Although the antennae 11–14 shown in FIG. 1 are placed immediately one above the other, and although it has not been illustrated in any of the FIGS., it is obvious that the antennae may also be placed such that they overlap the antennae in the row below.

The signal from each antenna is fed to an individual receiver 32. If the received signal is analog, the output signal is fed out from the receiver 32 to an analog/digital converter 33 and thereafter to a data processing unit 35 via an interface unit 34. If the sensors 15 are of a type such as answer to a call via an identifying unit 30, some of the antennae may be connected to a transmitter 36. The data processing unit 35 may activate these individually at given times so that they transmit codes selected by the data processing unit for activating individual sensors.

An output on the data processing unit is connected to a display unit 37, presenting data concerning the state of the furnace in a well-arranged manner, e.g. as a perspective view of the furnace interior presented on a display. Presentation can also take place by having two longitudinal sections taken at right angles to each other presented side by side on the display.

The data processing unit thus identifies the position, and ascertains the environmental conditions of each individual sensor with the aid of the incoming signals from each connection 32–34, presenting on the display 37 such information as isotherms and graphs of different chemical conditions in different colours on the same display, or the arrangement may be such that an operator can key in a picture presenting desired alternatives on the display. The display unit 37 also include a recorder. The display does not necessarily have to be in the form of pictures but can also be in the form of numerical values. For one skilled in the art, the provision of a program for the data processing unit 35 should not provide any problem, and therefore no examples of such a program are presented here.

A further embodiment for indicating the position of the separate sensors in the furnace is illustrated in FIGS. 5 and 6. An embodiment of a sensor 40 suitable for cooperating with this position indicator is shown in FIG. 7. In FIG. 5 there is schematically shown a sensor 40, which has a loop-type transmitter antennae with a dipole characteristic, and at a distance from the dipole the radiation diagram for the field strength of the magnetic field H is circular. As will be seen from the schematic diagram in FIG. 6, a plurality of receiver antennae units 41–48 are placed around the furnace. The schematic construction of an embodiment of a receiver antennae unit 45 will be seen from FIG. 5. The unit has a loop 49 for scanning the dipole field H horisontally and radially from the furnace, i.e. along the $\xi$-axis in the vector diagram to the right in FIG. 5, and a loop 50 for scanning the field H vertically, i.e. along the $\eta$-axis of the vector diagram. In this embodiment the sensors are preferably implemented, such that at least the unit provided with an antenna in each sensor is kept horizontal by gravity, so that the radiation diagram will be as shown in FIG. 5. It is also possible to provide each receiver antenna unit with three loops for ascertaining the electromagnetic field in three orthogonal directions, in which case no particular measure needs to be taken to keep the transmitter antenna horizontal. With many receiver antenna units placed around the furnace, determination of the possible slope of the transmitter antenna is also enabled with the aid of the superfluous determination of the position thus obtained. It is thus not entirely necessary to keep the sensor antennae horizontal, even if this is to be preferred from a practical standpoint.

As will be seen from the vector diagram in FIG. 5 for the receiver antenna unit 45, the field strength is obtained in two orthogonal directions along the tangent at a point on the circular field. Calculating the transmitter position is then made with the aid of the received signals from all the receiver antenna units with the aid of purely geometrical calculations.

As will be seen in FIG. 6, the receiver antenna units are preferably placed at two levels around the furnace, with four receivers at each level. There is an imaginary horizontal plane at the upper level, this plane containing two orthogonal axes $x_1$ and $y_1$ with the origin at the central axis of the furnace. Two of the receivers 41 and 43 are placed on the $x_1$ axis on either side of the origin and two of the receivers 42 and 44 on the $y_1$ axis on either side of the origin. Even though it is actually possible to calculate the positions of the sensors using only three receivers placed around the furnace, the illustrated arrangement with four receivers 41–44 makes the calculation simpler. At the lower level there is similarly an imaginary horizontal plane with two orthogonal axes $x_2$ and $y_2$. Two of the receivers 45,47 are placed on the $x_2$ axis and two receivers 46,48 on the $y_2$ axis. It would be sufficient to have receivers only at one level, geometrically to determine the position of a sensor 40, but some uncertainty can occur as to whether the sensor 40 is above or below the level in question. Furthermore, it is an advantage to have many receiver antenna units, since a more reliable positional determination of a sensor can then be obtained.

The receiver antennae can be dimensioned with relatively small loops, and they may therefore be accommodated in the lining on the inside of the blast furnace jacket, even if they are not oriented along the lining, as illustrated in the embodiment according to FIG. 1, but are placed with their extension at right angles to it. The different sensors can be picked out with the same methods as those described in connection with the embodiment described in conjunction with FIG. 1, i.e. by different carrier frequencies, or time positions for transmitted signals, or by the different sensors being activated separately. A circuit of the same kind in principle as the circuit 32–37 in FIG. 1 may be connected to the receiver antenna units.

A suitable embodiment is illustrated in FIG. 7 for a sensor 40 to be used with the embodiment of the invention illustrated in FIGS. 5 and 6, especially when the transmitter antenna is to be kept horizontal. The sensor 40 has a spherically shaped casing 52 more than half-filled with a liquid 53. A capsule 54 of some electrically insulating material floats in the liquid. The capsule has the shape of a truncated cone with its base upwards and is suitably provided with a weight (not shown) at its small end. The transmitter antenna 51 is suitably placed on the upper (base) side 55 of the capsule and has been implemented as a spiral in the illustrated embodiment, suitably as a printed circuit on the base 55. The electrical circuits of the sensor are placed in the capsule 54.

Sensing means 56,57 are placed on the exterior of the casing and are connected with relatively long lines 58,59 to the circuits in the capsule 54. It should be noted that certain properties of the surroundings, e.g. atmospheric pressure, can also be sensed by means placed inside the capsule. The size of the capsule 54 is adjusted such that it can still float in the liquid even when a comparatively large amount of the liquid has evaporated through the wall of the casing, the latter being porous in the same way as the wall 19 in the embodiment of the sensor illustrated in FIG. 3. It will of course be noted that the sensor illustrated in FIG. 7 can also be used in the embodiment illustrated in FIG. 1, with determination of the positions of the sensors by indications from the signal strength of the signals transmitted by the sensors. The circuits in the capsule 54 can have the principle implementation illustrated in FIG. 4.

Many modifications are possible within the scope of the invention. For example, transmission of information from the sensors to the furnace wall does not need to take place via electromagnetic waves, and each sensor can be provided with a loud speaker communicating with microphones placed in the furnace wall instead of the antennae illustrated in FIG. 1. Sensors with implementation other than that illustrated in FIG. 3 are also quite conceivable. The temperature probe 16 used in the sensors may be a diode or a bimetal transducer, and may be connected in a circuit giving a signal change, e.g. in the form of a digital code or frequency change, which is unambigously tied to the temperature. Measurement data obtained with the aid of the data processing unit 36 can also, to advantage, be calculated on differential values such as sinking rate, temperature change, change in CO etc. Measuring data can then be presented in the form of vectors, where the length represents the variable, e.g. the CO content, with the position in the furnace as base point and the temperature given, for example, in isotherms. An extra sensing means on the sensor can also sense the flow rate of the surrounding atmosphere.

We claim:

1. In a method of obtaining measurement data from a process which comprises introducing a mass into a confined space, subjecting the mass in the confined space to chemical or mechanical change, and obtaining measurement data from the mass while it is subject to said change in said confined space, the improvement wherein said measurement data is obtained by:

providing a plurality of individual, unconnected, sensors in said mass in said confined space, each sensor comprising at least one sensing means for sensing a property of said mass, an acoustic or electromagnetic wireless transmitter connected to said sensing means for transmitting a signal representative of a sensed property of said mass;

providing a plurality of discrete wireless signal receiving means over the surface defining said confined space for receiving signals from said transmitter;

determining, from a property of a signal received by each of said plurality of signal receiving means, the position in said confined space of each of said sensors;

determining, from said signal received by each of said plurality of signal receiving means, said sensed property of said mass; and displaying for each of said sensors, an indication of its location in said mass and a property of said mass sensed at that location.

2. A method according to claim 1 wherein said confined space is defined by a vessel having an inlet for the introduction of said mass and an outlet for the removal of said mass after the mass undergoes a physical or chemical change within said vessel.

3. A method according to claim 1 wherein said sensors are admixed into said mass as said mass is introduced into said confined space.

4. A method according to claim 2 wherein said mass moves through said vessel from said inlet to said outlet as the mass undergoes said physical or chemical change.

5. A method according to claim 1 wherein said mass undergoes a chemical change while in said confined space.

6. A method according to claim 1 wherein the property of the received signal used for determining the location of a sensor in said mass comprises signal strength, time position, or field direction.

7. A method according to claim 1 wherein said confined space is defined by a vessel and wherein said plurality of wireless signal receiving means comprise antennae located within the wall of said vessel.

8. A method according to claim 7 wherein said vessel comprises a blast furnace and wherein said mass comprises iron.

9. Apparatus for obtaining measurement data from a mass in a confined space, said mass undergoing a chemical or mechanical change in said space, comprising:

a plurality of individual, unconnected sensors adapted to be provided in said mass in said confined space, said sensors each comprising a wireless transmitter and sensing means connected to said transmitter for sensing a property of a mass in said confined space, said transmitter comprising means for sending signals with information concerning a property sensed by said sensing means;

a plurality of discrete signal receiving means for receiving said signals mounted over the surface defining said confined space;

calculating and evaluating circuit means for calculating, using a property of a received signal, the positions of the sensors in said confined space; and display means for displaying, for each of said sensors, an indication of its location in said mass and a property of said mass sensed at that location.

10. Apparatus as claimed in claim 9 wherein said signal receiving means comprises antennae and wherein said confined space is defined by a vessel.

11. Apparatus as claimed in claim 10 wherein said vessel comprises a blast furnace having a jacket and a lining and wherein said antennae are let into the lining inside the jacket of said furnace.

12. Apparatus as claimed in claim 9 wherein said space is defined by a vessel, said vessel having an inlet for introduction of said mass into said vessel, and wherein said signal receiving means are arranged in groups, each group containing at least three such signal receiving means placed around said space with each means in the group at substantially the same distance from said inlet, said groups being placed in sequence one after the other in a direction away from said inlet.

13. Apparatus as claimed in claim 9 further comprising means for transmitting call signals to said sensors, and wherein said sensors comprise means for receiving said call signals and means for activating the sensor transmitter to send information in response to a call signal.

14. Apparatus as claimed in claim 9 wherein the sensors are provided with oscillators having a carrier frequency such that the oscillators in the different sensors send a signal including the measurement signals from the sensing means modulated on the carrier frequency of the oscillator; and wherein said calculation and evaluation circuit comprises means for individually separating the signals sent from the different sensors responsive to the different carrier frequencies of the received signals.

15. Apparatus as claimed in claim 9 wherein the sensors comprise means for transmitting information at individual times for each sensor; and wherein said signal receiving means comprises means for separating the signals sent from the different sensors responsive to said individual times.

16. Apparatus as claimed in claim 9 wherein the sensors are provided with a porous casing saturated by a vaporizable liquid, the vaporization of which is sufficient to keep the temperature of the interior of the sensor at a level substantially less than the surrounding temperature.

17. Apparatus as claimed in claim 9 wherein the calculation and evaluation circuit means further comprises means for calculating measurement data relating to differential values from the signals obtained from the different sensors.

* * * * *